United States Patent [19]

Thome et al.

[11] 4,318,534

[45] Mar. 9, 1982

[54] PLATE QUENCH

[75] Inventors: William L. Thome, Toledo, Ohio; Robert A. Schmall, Temperance, Mich.

[73] Assignee: Midland-Ross Corporation, Cleveland, Ohio

[21] Appl. No.: 195,537

[22] Filed: Oct. 9, 1980

[51] Int. Cl.[3] ..... C21D 9/56

[52] U.S. Cl. ..... 266/113; 266/127; 266/259

[58] Field of Search ..... 266/111, 112, 113, 114, 266/121, 127, 259; 134/122 R

[56] References Cited

U.S. PATENT DOCUMENTS

| | | | |
|---|---|---|---|
| 3,300,198 | 1/1967 | Clumpner et al. | 266/113 |
| 3,533,261 | 10/1970 | Hollander et al. | 266/113 |
| 3,914,135 | 10/1975 | Kozasu | 266/113 |
| 3,995,684 | 12/1976 | Schmid | 134/122 R |
| 4,047,985 | 9/1977 | Greenberger | 266/114 |

FOREIGN PATENT DOCUMENTS

| | | | |
|---|---|---|---|
| 870556 | 6/1961 | United Kingdom | 266/113 |

*Primary Examiner*—L. Dewayne Rutledge
*Assistant Examiner*—John P. Sheehan
*Attorney, Agent, or Firm*—Harlan E. Hummer

[57] ABSTRACT

A plate quenching apparatus is described as having a horizontally elongated chamber in which a plurality of rows of metal, tire-like rollers are used to support an element, such as a number number of metal plates, as the element moves along a horizontal pathway between opposing rows of nozzles above and below the pathway. Unfortunately, the metal rollers create wakes when large quantities of quenching liquid are used. These wakes literally surround tear-shaped areas immediately downstream the rollers and prevent adequate amounts of quenching liquid from contacting the element in these areas, especially at the beginning of the quenching process wherein it is critical to uniformly contact the element with quenching material. A plurality of nozzles are specially positioned between adjacent rows of the metal rollers to break up the wakes and insure that the sheet of metal is uniformly contacted with quenching liquid to prevent the element from becoming buckled, warped, or twisted during the quenching operation. A unique nozzle arrangement is provided adjacent the exit of the apparatus for preventing large amounts of spent quenching liquid, carried atop the element, from exiting the apparatus with the element. The nozzles located above the traveling element are arranged to provide overlapping streams of liquid to continuously contact the longitudinal trailing ends of the element with steady streams of quenching liquid adjacent the opening through which the web enters the chamber of the plate quenching apparatus to prevent alternate cooling and reheating of these ends which normally occurs when the nozzles are inadequately arranged to produce spaced and not overlapping streams of liquid.

7 Claims, 5 Drawing Figures

PLATE QUENCH

BACKGROUND OF THE INVENTION

The invention is particularly well suited for use in an apparatus that is designed to quench individual metal plates composed of any suitable material, e.g. aluminum or steel, after the metal plates have passed from a heat treatment furnace. Such quenching apparatuses employ a plurality of rows of metal tire-like wheels or rollers which are driven, in unison, to move and support the hot metal plates as they pass along a fixed horizontal pathway through an enclosed chamber where the hot metal plates are contacted with liquid from a series of nozzles which are located above and below the pathway to direct streams of liquid against the metal plates in a downstream direction relative to the direction in which the metal plates travel. The quantity of the quenching liquid is naturally dependent upon the thickness of the metal plate being quenched.

A wake, somewhat similar to that created by a boat, is produced by the rollers as they contact the quenching liquid. These wakes circumvent and isolate tear-shaped areas of the metal plate extending from the leading edges of the rollers, first to contact the liquid, downstream behind the rollers, and prevent adequate liquid from contacting the metal plate in these areas, thereby creating non-uniform quenching of the metal plate during the initial, highly critical stage of the quenching process. Such non-uniform quenching causes the metal plate to buckle and twist making the distorted metal plate exceedingly difficult to handle and, oftentimes, unacceptable from a flatness standpoint. Moreover, the wakes interfer with the rate at which it is necessary to quench the metal plate to produce the metallurgical properties desired in the metal plate. The invention is primarily designed to overcome this problem by the provision and location of nozzles which are positioned to eliminate or substantially reduce the wakes caused by the rollers so that the metal plate when it is hottest at the beginning of the quenching process is uniformly contacted with liquid.

Briefly stated, the invention is in a quenching apparatus that comprises a horizontally elongated chamber in which a plurality of transversely oriented rows of parallel metal, tire-like wheels or rollers are located to support an element as it travels along a fixed horizontal pathway through the apparatus. A plurality of nozzles are positioned vertically above and below the pathway to impinge quenching liquid against the element. The nozzles located below the pathway adjacent the opening through which the element enters the apparatus, are positioned between adjacent rows of rollers to impinge streams of liquid to disrupt and substantially eliminate the wakes created by the rollers as large quantities of high velocity quenching liquid contact them. It can be appreciated from above that the term "element", as used herein, has reference to continuous or discrete plate-like material which has a length and width sufficient for the supporting rollers to create wakes thereagainst, as distinguished from small wire-like material.

Another aspect of the invention is in the particular location of the nozzles above the pathway adjacent the entrance opening. Such nozzles are positioned to produce overlapping patterns of liquid at least initially against the element to insure complete coverage of the element with liquid, especially the trailing end of the element which, in the past, has sometimes been alternately cooled and reheated as it passes between spaced streams of liquid from inadequately positioned nozzles.

Still another aspect of the invention is in the positioning of nozzles above the pathway adjacent the end of the apparatus from which the element exits to direct streams of liquid in a counterflow direction against liquid flowing atop the traveling element and attempting to escape or exit the apparatus with the element.

As previously indicated, large quantities of high velocity liquid are used to quench thicker metal plates providing a horrendous problem of excess liquid disposal, as this large volume of water literally attempts to escape the apparatus with the moving plates. A number of blow-off nozzles are provided to cooperate with the counterflow nozzles adjacent the exit end of the apparatus to direct streams of fluid in lateral directions against the liquid moving atop the traveling plates, to blow such liquid laterally off the opposing longitudinal marginal edges of the plates and help prevent the undesireable exodus of liquid from the apparatus.

DESCRIPTION OF THE DRAWING

The following description of the invention will be better understood by having reference to the accompanying drawing, wherein.

THE ENVIRONMENT OF THE INVENTION

Figure 1:
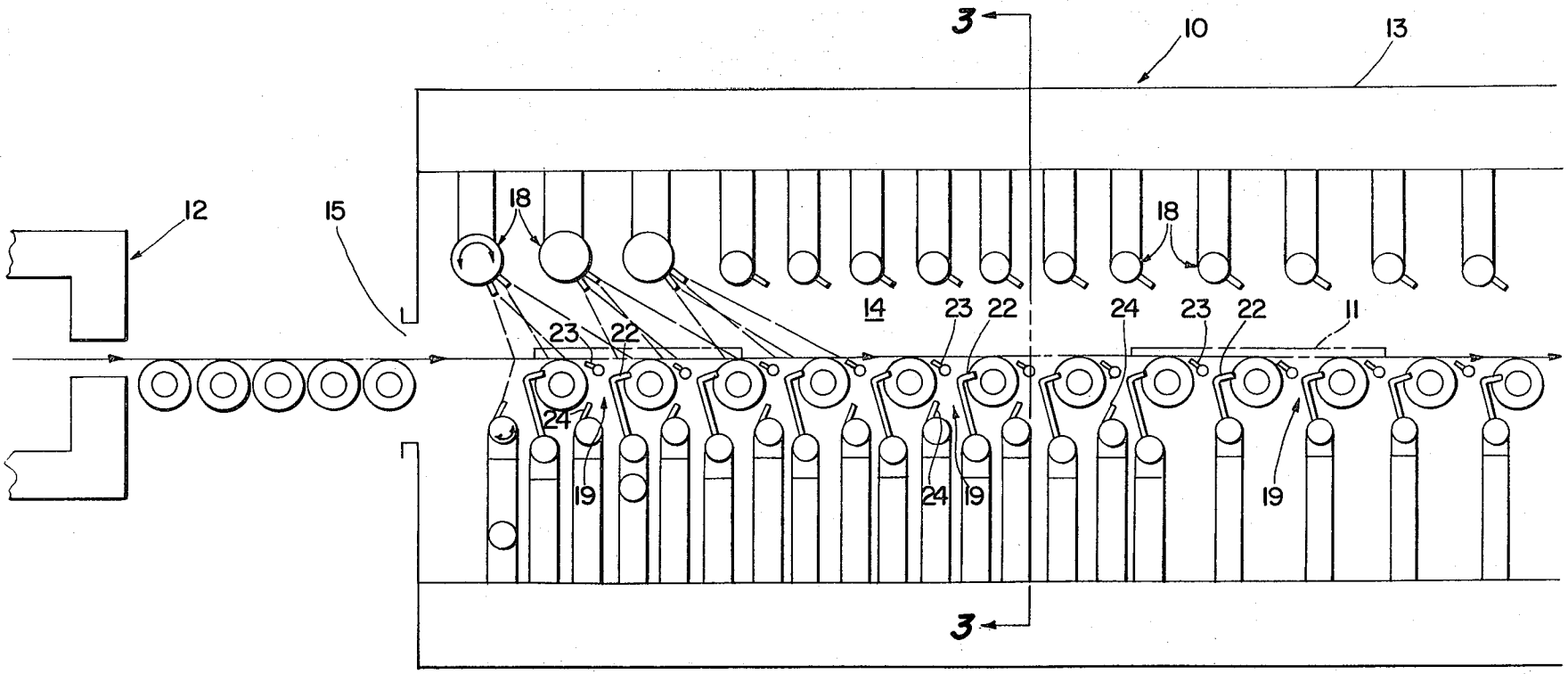
FIGS. 1–1A is a longitudinal cross-sectional view of a quenching apparatus that is made in accordance with the invention.
Figure 1A:
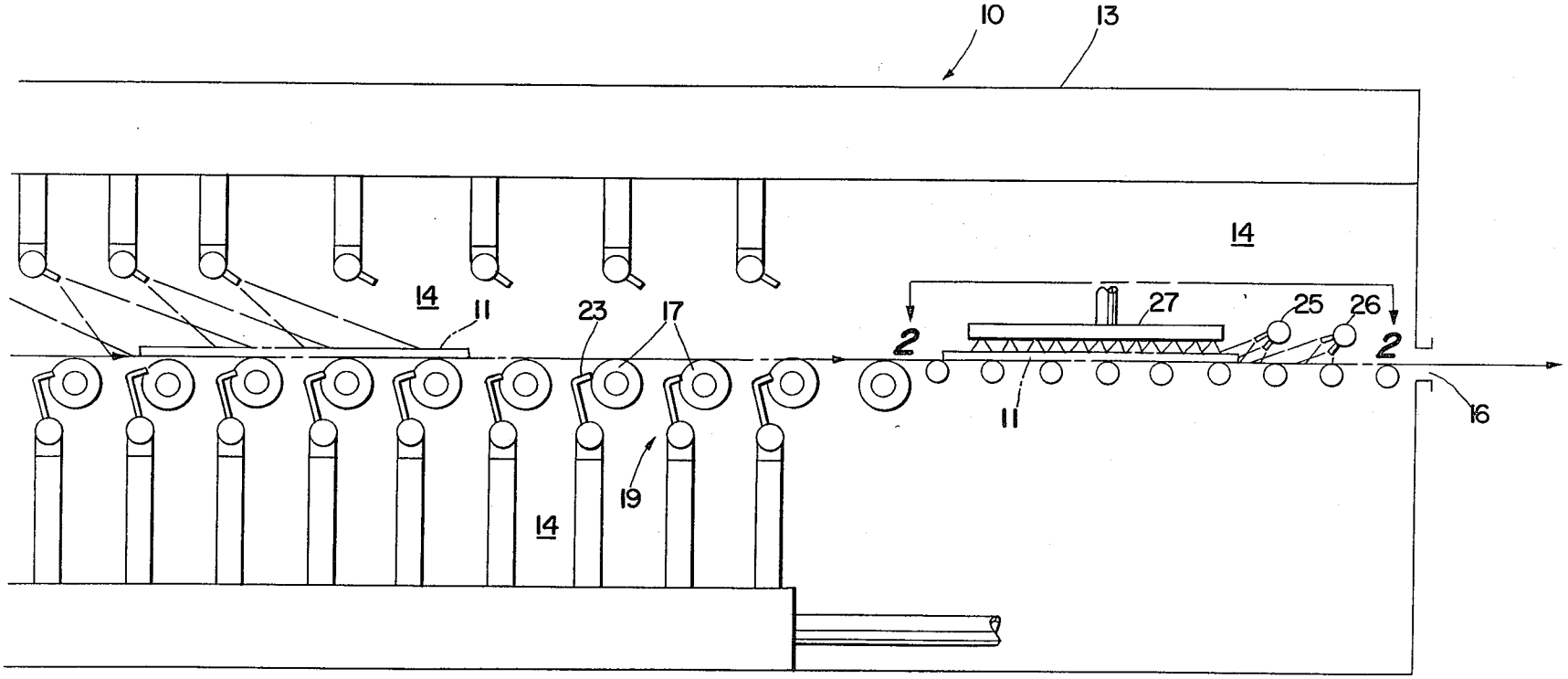
Figure 3:
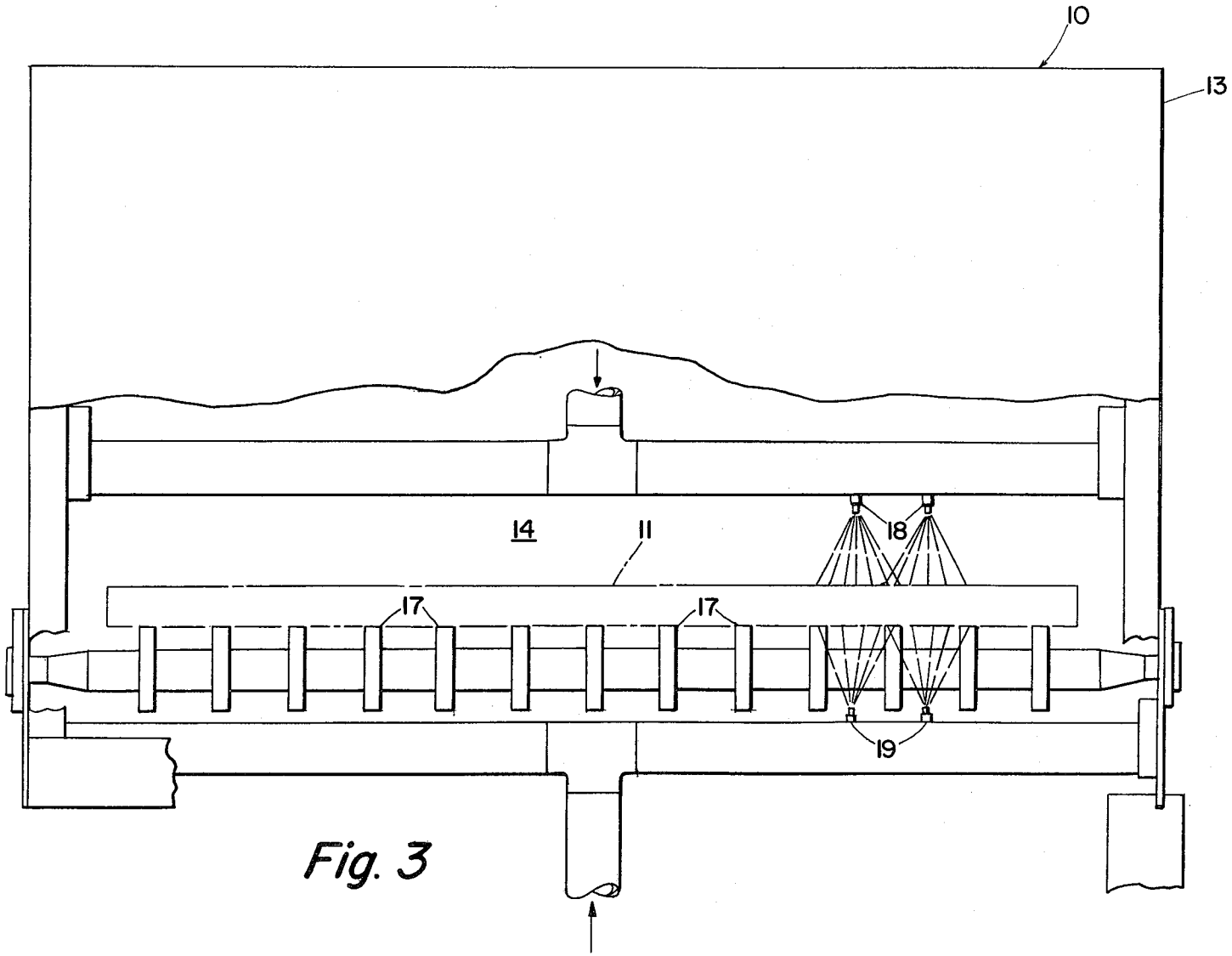
FIG. 3 is a transverse section of the apparatus viewed from the line 3—3 of FIGS. 1–1A.

With general reference to the drawing for like parts, and more particular reference to FIGS. 1–1A and 3, there is shown an apparatus 10 which is designed to quench a heated element, such as a plurality of individual aluminum or steel plates 11, after the metal plates 11, for example, leave a heat treatment furnace 12. The quenching apparatus 10 comprises a horizontally elongated housing 13 which encloses a similarly oriented chamber 14 in which the metal plates 11 are contacted by any suitable quenching liquid, e.g. water. The housing 13 has an entrance opening 15 and an exit opening 16 through which the metal plates 11 enter and leave the treatment chamber 14.

A plurality of transversely oriented rows of similar, parallel, metal tire-like wheels or rollers 17 are spaced longitudinally of the chamber 14 to support the metal plates 11 in a fixed horizontal pathway between the entrance and exit openings 15, 16, as the metal plates travel through the quenching apparatus 10. The rollers 17 of each row are closely spaced, for example, about twelve inches apart and are driven or rotated, in unison, by any suitable means.

A plurality of transversely oriented top and bottom rows of similar, parallel nozzles 18, 19, are spaced longitudinally of the chamber 14 above and below the pathway to impinge streams or jets of quenching liquid against the traveling metal plates 11 in a downstream direction, relative to the direction in which the metal plates 11 travel through the quenching apparatus 10.

Those skilled in the art realize that the most critical period of the quenching process occurs in the beginning when the metal plates are the hottest, e.g. heated to a temperature of 900° F.–1000° F. in cases where the metal plates are composed of aluminum. It is important at this time to contact the metal plates 11 uniformly with large quantities of quenching liquid. Thus, the number and location of the nozzles adjacent the entrance opening 15 of the treatment chamber 14 is important and critical to the uniform quenching of the metal plates 11. The nozzles closer the entrance opening are designed to impinge greater volumetric streams of high velocity liquid against the metal plates 11 as they enter the treatment chamber 14, than the nozzles further downstream from the entrance opening 15. It can be appreciated from a study of FIGS. 1–1A, that successive downstream nozzles are sized to impinge succeedingly smaller streams of quenching liquid against the traveling metal plates 11.

Figure 4:
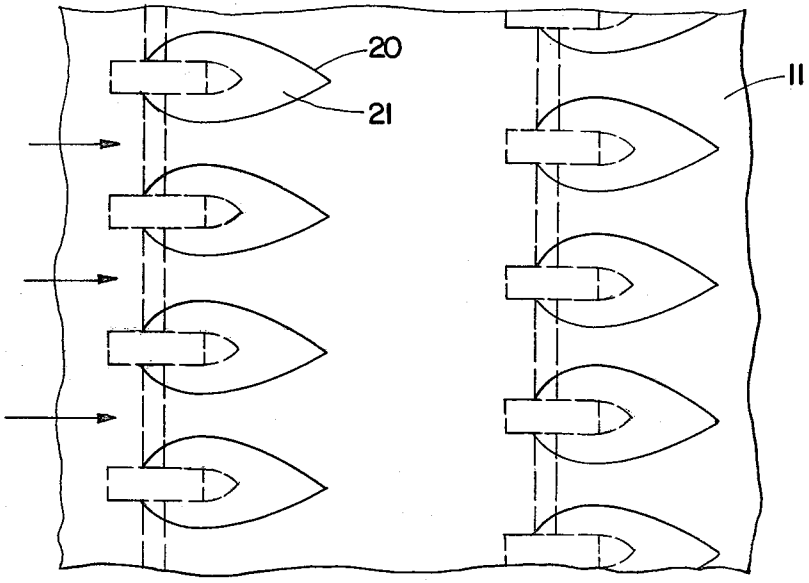
FIG. 4 is a top schematic view designed to illustrate the wakes that are created by the quenching liquid as it contacts the rollers used to support the traveling element.

With particular reference to FIG. 4, there are shown similar wakes 20 which are created beside and downstream behind each of the rollers 17, especially when large quantities of high velocity quenching liquid contact the rollers 17. The wakes 20 produce corresponding, generally tear-shaped areas 21 of metal plates which are not adequately contacted with quenching liquid. Thus, the extremely hot metal plates 11 are not initially uniformly contacted with liquid and quenched, thereby producing uneven thermal contraction of the metal plates 11 and consequent undesireable buckling and twisting of the metal plates 11. Moreover, highly distorted metal plates 11 can experience a cooling and reheating cycle which has a deleterious effect upon the physical characteristics of the finished metal plate 11. Thus, it is desireable to eliminate these wakes 20, especially at the beginning of the quenching process. It has been found that wakes 20 are not a critical factor when, for example, the metal plates being quenched are at temperatures below 400° F.

THE INVENTION

With particular reference to FIGS. 1–1A and 3, the first eight rows of nozzles 19 located vertically below the pathway of the traveling metal plates 11 adjacent the entrance opening 15, are specifically designed to disrupt or break up the wakes 20 and tear-shaped areas 21 behind the rollers 17 so that the quenching liquid will more uniformly contact the traveling metal plates 11. The first eight rows of nozzles 19 below the pathway each include three rows or series of nozzles 22,23,24 between each pair of adjacent upstream and downstream rows of rollers 17. The first series of nozzles 22 have their discharge openings positioned close to the pathway adjacent the downstream rows of rollers 17 to direct angular relatively high velocity streams of liquid downstream against the undersides of the metal plates 11 just in front of and aside the rollers 17 of the downstream row of rollers 17 to disrupt and substantially reduce and restrict the wakes to a smaller area immediately behind the rollers 17 (note smaller dotted wake areas of FIG. 4 for comparison). The longitudinal axes of this first series of nozzles 22 are preferably disposed at angles less than 45° to the plane of the pathway, e.g. 10°–20°. A second series of nozzles 23 have their discharge openings even closer the pathway adjacent the upstream rollers 17 to direct relatively low velocity streams of quenching liquid in an upstream direction into the reduced wake areas directly behind the rollers 17. The third series of nozzles 24 have their discharge openings positioned farthest from the pathway adjacent the upstream rows of rollers 17 to direct relatively high velocity streams of quenching liquid generally vertically upwardly against the undersides of the traveling metal plates between the adjacent rows of rollers 17 to insure that a sufficient amount of quenching liquid contacts the metal plates 11. The longitudinal axes of the third series of nozzles 24 are preferably disposed at angles greater than 45° to the plane of the pathway of the traveling metal plates 11, e.g. 55°–65°. Thus, the three series of nozzles 22,23,24, located below the pathway between adjacent rows of rollers 17, are designed to eliminate the wakes created by the rollers at least during the first 15–20 feet of the quenching process, where such wakes critically interfere with the uniform quenching of the traveling metal plates 11, and insure that proper amounts of quenching liquid contact the metal plates 11.

The first top and bottom rows of nozzles 18,19, to encounter the metal plates 11 as they enter the entrance opening 15, are angularly adjustable so that the streams of liquid from the nozzles thereof can be directed to contact the same longitudinal points of the metal plates 11 to prevent cupping or bowing of the metal plates covered when the top and bottom sides of the metal plates are not simultaneously contacted with quenching liquid at the same longitudinal position. The first four, top rows of nozzles 18 are positioned to direct overlapping streams or patterns of quenching liquid against the traveling metal plates 11 in a downstream direction as the metal plates 11 enter the chamber 14 to insure complete coverage of the trailing ends of the metal plates 11 so that they will not experience alternate cooling and reheating as they pass through the quenching apparatus. This problem occurs in existing devices wherein the sprays or nozzles are simply not designed to produce overlapping streams or patterns of liquid, so that the trailing ends of the metal plates, are intermittently contacted with quenching liquid as they pass between improperly spaced, non-overlapping patterns of liquid that are sprayed or impinged against the traveling metal plates 11 as they enter the treatment chamber 14.

Figure 2:
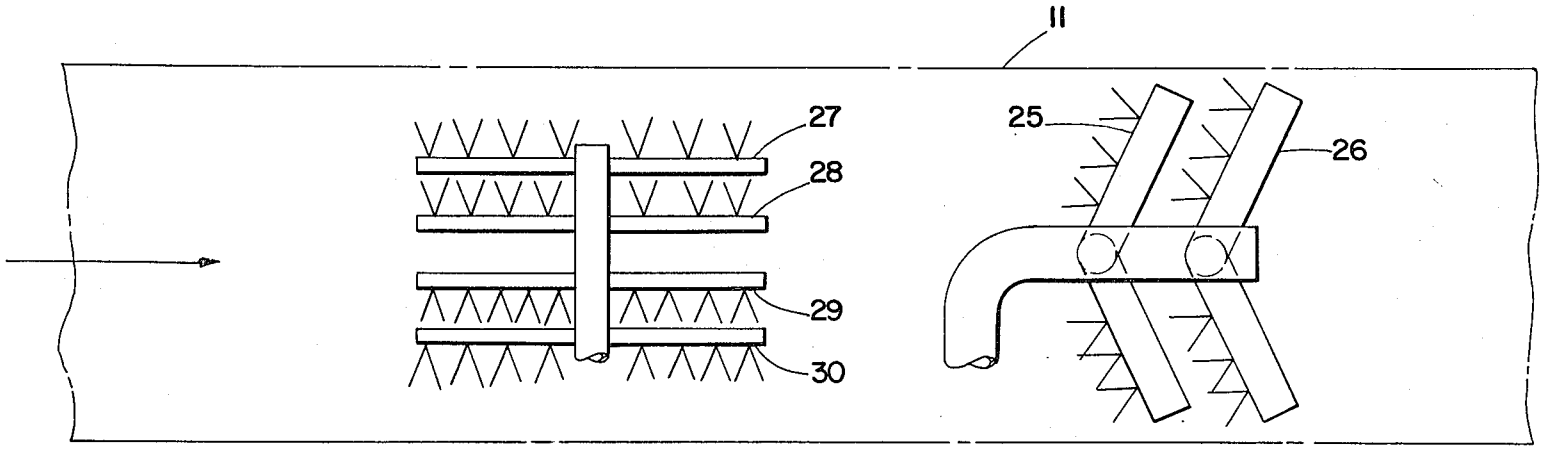
FIG. 2 is a plan view of the exit end of the apparatus viewed from the line 2—2 of FIGS. 1–1A.

With particular reference to FIGS. 1–1A and 2, there is shown another aspect of the invention which is in the provision adjacent the exit opening 6 of a plurality of transversely oriented rows of similar nozzles 25,26 which are located vertically above the pathway and designed to impinge high velocity streams of liquid against the traveling metal plates 11 in a counterflow upstream direction to break up the massive flow of spent quenching liquid that is flowing and carried atop the metal plates 11, as they pass from the quenching apparatus 10, and stop the escape of quenching liquid through the exit opening 16. The rows of counterflow nozzles 25,26 can be straight and at right angles to the traveling metal plates 11, or chevron-shaped, as shown. The chevron-shaped nozzles 25,26 are designed to force the excess liquid laterally over the longitudinal marginal edges of the metal plates 11.

A plurality of longitudinally extending rows of similar blow-off nozzles 27–30 are provided upstream adjacent the counterflow nozzles 25,26 to blow fluid transversely or laterally against the moving stream of spent quenching liquid atop the moving metal plates 11, to force such liquid over the adjacent longitudinal marginal edges of the metal plates 11. Thus, between the counterflow nozzles and the blow-off nozzles, sufficient force is provided to stop the mass exodus of quenching liquid from the quenching apparatus 10.

Thus, there has been described a quenching apparatus which produces highly improved quenched metal plates. Further, there is described an apparatus in which the massive amounts of quenching liquid used in the quenching process, are confined to the apparatus and prevented from accompanying the metal plates as they exit the apparatus. The nozzles may be of conventional design, since it is the positioning of the nozzle which is important in, (I) the elimination of the wakes created by the rollers, (II) the elimination of unquenched hot spots occurring especially at the trailing end of a metal plate which can cause undesireable cooling and reheating of the metal plates, and (III) the removal of excess quenching liquid attempting to escape from the quenching apparatus atop the metal plate.

What is claimed is:

1. An apparatus for quenching a heated element, such as a metal plate comprising:

(a) a horizontally elongated chamber having entrance and exit openings through which the element enters and leaves the chamber;

(b) means for guiding the element along a substantially horizontal pathway through the chamber between the openings, said means including a plurality of transversely oriented rows of rollers for supporting the element, each row of the plurality of rows of rollers comprising a number of individual tire-like rollers which are parallel and rotatable about a common axis that is normal to the direction of travel of the element, the individual rollers each creating a wake downstream therebehind as they are contacted by liquid used to quench the element, the wakes preventing adequate liquid from contacting and uniformly quenching the element;

(c) a plurality of transversely oriented rows of nozzles located above and below the pathway for impinging quenching liquid against the element as it travels along the pathway, the rows of nozzles located below the pathway including, (i) a first series of nozzles located upstream closely in front of the individual rollers, relative to the direction of travel of the element, at least adjacent the entrance opening, to direct relatively high velocity streams of liquid downstream slightly in front of and aside the adjacent downstream rollers to reduce and restrict the wakes to a smaller area immediately downstream behind the rollers, and (ii) a second series of nozzles positioned downstream closely behind the individual rollers, at least adjacent the entrance opening, to direct relatively low velocity streams of liquid generally upstream into the smaller areas defined by the reduced wakes downstream behind the rollers to eliminate or substantially reduce the wakes, thereby producing more uniform quenching of the element.

2. The apparatus of claim 1, wherein the plurality of rows of nozzles located vertically above the pathway of the element include a plurality of rows of nozzles positioned at least adjacent the entrance opening to impinge against the element overlapping streams of liquid in a downstream direction relative to the direction of travel of the element.

3. The apparatus of claim 1, which includes:

(d) a plurality of rows of counterflow nozzles positioned vertically above the pathway of the element adjacent the exit opening to direct streams of liquid against liquid moving atop the traveling element to break up the moving liquid and prevent the movement thereof through the exit opening with the element; and (e) a plurality of rows of blow-off nozzles positioned vertically above the pathway of the element upstream from and adjacent the rows of counterflow nozzles to direct fluid laterally against the moving liquid atop the element to force such liquid laterally from atop the element over adjacent longitudinal marginal edges of the element.

4. The apparatus of claims 1, 2 or 3 which includes means for angularly adjusting the nozzles of the first rows of nozzles above and below the pathway to encounter the element as it enters the chamber.

5. An apparatus for quenching an element, such as a metal plate, comprising:

(a) a horizontally elongated chamber having entrance and exit openings through which the element enters and leaves the chamber;

(b) means for guiding the element along a substantially horizontal pathway through the chamber between the openings, said means including a plurality of transversely oriented rows of rollers for supporting the element, each row of the plurality of rows of rollers including a number of individual, tire-like rollers which are parallel and rotatable about a common axis that is normal to the direction of travel of the element, the individual rollers each creating a wake downstream therebehind as they are contacted by liquid used to quench the element, the wakes preventing adequate liquid from contacting and uniformly quenching the element at least at the beginning of the quenching process when the element first enters the chamber;

(c) means for rotating the rollers, in unison;

(d) a plurality of transversely oriented rows of nozzles spaced longitudinally below the pathway for impinging quenching liquid against the element as it travels along the pathway, the rows of nozzles positioned between adjacent rows of upstream and downstream rollers, relative to the direction of travel of the element, including, a first series of nozzles located upstream closely in front of the individual rollers at least adjacent the entrance opening to direct relatively high velocity streams of liquid downstream slightly in front of and aside the adjacent downstream rollers to reduce and restrict the wakes to a smaller area immediately downstream behind the rollers, and a second series of nozzles located downstream closely behind the individual rollers at least adjacent the entrance opening to direct relatively low velocity streams of liquid generally upstream into the smaller areas defined by the reduced wakes behind the upstream rollers, and a third series of nozzles at least adjacent the entrance opening for directing relatively high velocity streams of liquid into the spaces between the adjacent upstream and downstream rows of rollers; and (e) a plurality of transversely oriented rows of nozzles located above the pathway for impinging quenching liquid against the element as it travels along the pathway, said rows of nozzles including a plurality of rows of nozzles positioned at least adjacent the entrance opening to impinge against the element overlapping streams of liquid in a downstream direction.

6. The apparatus of claim 5, which includes:

(f) means for angularly adjusting the nozzles of the first rows of nozzles, above and below the pathway, to encounter the element as it enters the chamber.

7. The apparatus of claim 6, which includes:

(g) a plurality of rows of counterflow nozzles positioned vertically above the pathway of the element adjacent the exit opening to direct streams of liquid against the liquid moving atop the traveling element, to break up the moving liquid and prevent the movement thereof through the exit opening with the element; and (h) a plurality of rows of blow-off nozzles positioned vertically above the pathway of the element upstream from and adjacent the rows of counterflow nozzles to direct fluid laterally against the moving liquid atop the element to force such liquid laterally from atop the element over adjacent longitudinal marginal edges of the element.

* * * * *